US008631899B2

(12) United States Patent
Zickmantel

(10) Patent No.: US 8,631,899 B2
(45) Date of Patent: Jan. 21, 2014

(54) SOUND ABSORBER

(75) Inventor: Frank Zickmantel, Kreischa (DE)

(73) Assignee: Silenceresearch GmbH, Cologne (DE)

( * ) Notice: Subject to any disclaimer, the term of this patent is extended or adjusted under 35 U.S.C. 154(b) by 0 days.

(21) Appl. No.: 12/739,567

(22) PCT Filed: Oct. 21, 2008

(86) PCT No.: PCT/EP2008/064183
§ 371 (c)(1),
(2), (4) Date: Apr. 23, 2010

(87) PCT Pub. No.: WO2009/053349
PCT Pub. Date: Apr. 30, 2009

(65) Prior Publication Data

US 2010/0307866 A1 Dec. 9, 2010

(30) Foreign Application Priority Data

Oct. 24, 2007 (DE) ..... 102007000568

(51) Int. Cl.
*E04B 1/82* (2006.01)

(52) U.S. Cl.
USPC ..... 181/286; 181/290

(58) Field of Classification Search
USPC ..... 181/286, 290, 294, 295
See application file for complete search history.

(56) References Cited

U.S. PATENT DOCUMENTS 2,112,631 A * 3/1938 MacDonald ..... 52/144
4,989,688 A * 2/1991 Nelson ..... 181/287

(Continued)

FOREIGN PATENT DOCUMENTS

CN 1809871 A 7/2006
DE 24 08 028 2/1974

(Continued)

OTHER PUBLICATIONS

Notification of Transmittal of Translation of the International Preliminary Report on Patentability for corresponding International Application No. PCT/EP2008/064183.

(Continued)

*Primary Examiner* — Jeremy Luks
(74) *Attorney, Agent, or Firm* — Andrew M. Calderon; Roberts Mlotkowski Safran & Cole, P.C.

(57) ABSTRACT

To provide an inexpensive, slender sound absorber, it has a plurality of porous layers or regions of different densities and different flow resistances respectively. Of significance are the boundary surfaces between the different, porous layers which are accompanied by changes in impedance. Homogenized and adapted flow resistance conditions should be avoided. Although the thermal frictional effect in the porous material is desired, in particular to absorb higher frequencies, according to the present invention it only forms one element of the absorptive working mechanism. In addition, the effect known in physics as refraction is used. At the boundary layer between two materials of different density and different flow resistance respectively there is an abrupt change in impedance. This leads to a phase shift of the sound wave, and so a sound absorbing effect is made possible. In contrast to exclusively porous absorber layers with homogeneously or steadily increasing flow resistances, frequently changing transitions and porous materials having different, respectively suitable, direct impedances allow much higher degrees of sound absorption to be achieved in the range of low frequencies, in particular between 100 Hz and 500 Hz.

24 Claims, 9 Drawing Sheets

(56) References Cited

U.S. PATENT DOCUMENTS

| | | | | |
|---|---|---|---|---|
| 5,518,806 | A * | 5/1996 | Eder et al. | 428/218 |
| 5,834,711 | A * | 11/1998 | Haines | 181/290 |
| 6,145,617 | A | 11/2000 | Alts | |
| 6,630,222 | B1 | 10/2003 | Fay et al. | |
| 6,644,435 | B2 * | 11/2003 | Elsasser | 181/207 |
| 6,698,543 | B2 * | 3/2004 | Golterman | 181/291 |
| RE39,010 | E * | 3/2006 | Gish et al. | 181/290 |
| 7,055,649 | B2 * | 6/2006 | Tompson et al. | 181/290 |
| 7,137,477 | B2 | 11/2006 | Keller et al. | |
| 2003/0066708 | A1 | 4/2003 | Allison et al. | |
| 2004/0002274 | A1 | 1/2004 | Tilton | |
| 2004/0238275 | A1 | 12/2004 | Keller et al. | |
| 2005/0026527 | A1 | 2/2005 | Schmidt et al. | |
| 2005/0217932 | A1 * | 10/2005 | Woodman et al. | 181/290 |
| 2006/0113146 | A1 * | 6/2006 | Khan et al. | 181/286 |
| 2007/0227815 | A1 * | 10/2007 | Nakamura | 181/290 |

FOREIGN PATENT DOCUMENTS

| | | |
|---|---|---|
| DE | 74 27 551 | 8/1974 |
| DE | 24 37 947 | 2/1976 |
| DE | 89 61 179 | 5/1989 |
| DE | 40 27 511 | 8/1990 |
| DE | 41 13 628 | 11/1992 |
| DE | 295 02 964 | 2/1995 |
| DE | 44 22 585 | 10/1995 |
| DE | 101 51 474 | 5/2002 |
| DE | 102 13 107 | 10/2003 |
| DE | 103 24 257 | 9/2004 |
| EP | 1 164 228 | 12/2001 |
| EP | 1 570 138 | 9/2005 |
| RU | 2003124950 A | 2/2005 |
| WO | 96/26331 | 8/1996 |
| WO | 03/031229 | 4/2003 |
| WO | 2004/013395 | 2/2004 |

OTHER PUBLICATIONS

International Preliminary Report on Patentability for corresponding International Application No. PCT/EP2008/064183.

Written Opinion of the International Searching Authority for corresponding International Application No. PCT/EP2008/064183.

Mechel, F. (1995) "Schallabsorber Band 2, Innere Schallfelder, Strukturen. Hirzel Verlag Stuttgart—Leipzig" pp. 39-55.

Mechel, F. (1998) "Schallabsorber Band #, Anwendungen. Hirzel Verlag Stuttgart—Leipzig" pp. 47-57.

Shi et al. "Acoustic design and analysis of multi-layered structure for sound absorbing", Applied Acoustics, vol. 26., No. 5, 2007, 4 pages, http://www.cnki.net.

* cited by examiner

SOUND ABSORBER

The invention relates to a sound absorber with the characteristics of the generic name known, for example, from the reference DE 24 37 947 OS.

It is known that open porous materials are suitable for muffling rooms. Typical building fabrics can be found in acoustic ceilings, for example. The adaption ratio of a so-called λ/4 porous absorber is to be considered according to $$800<\Xi^{*}d<2400 \text{ Pa*s/m}$$

in order to achieve a sound absorption of at least 80%. A body moving at a rate relative to a gaseous or liquid medium experiences a flow resistance in the form of a force acting opposite to the direction of motion. Ξ represents the length specific flow resistance and d represents the layer thickness of the absorber. The flow resistance of the porous absorber has thus to be chosen, so that the sound wave can penetrate it and that the particle movement forced by the airborne sound is muffled by friction in the material structure of the absorber. Too high flow resistances result in reflection at the front layer of the absorber, too low flow resistances in turn result in a penetration of the absorber without any friction loss.

Porous sound absorbers normally exhibit a homogenous sound absorbing layer. However, there are wedge-shaped structures as well, e.g. for lining rooms that have poor reflection. Wedge-shaped structures are achieved—in a direction towards the space limiting surfaces—by homogeneously increasing flow restrictions. The mixture ratio of air to fabric material forming the porous material steadily increases in a direction towards the space limiting surface. An equally high sound absorption is thus aspired across the entire frequency range.

It is also possible to easily realize an approximately wedge-shaped structure by means of foam materials. So, it is known to thread fibrous or porous cubes onto vertical wires with their sizes and densities increasing towards the wall. It is provided in said known solution that the individual cubes are to be spaced from each other.

Different foam materials might be disposed layered on top of each other for realizing a wedge-shaped structure, wherein the amount of material could increase from layer to layer towards the space limiting surface and the pores in the material could decrease. Adjusted flow ratios would have to be considered from layer to layer in order to minimize sound reflections at border layers and thus to approach the ideal wedge-shaped structure. The input impedances of the different structures would then be similar.

It is known from the references "Mechel, F. (1995) Schallabsorber Band 2, Innere Schallfelder, Strukturen. Hirzel Verlag Stuttgart—Leipzig" as well as "Mechel, F. (1998) Schallabsorber Band 3, Anwendungen. Hirzel Verlag Stuttgart—Leipzig" how to determine an input impedance of a porous sound absorber in front of a sound-reflecting back wall.

Enormous construction depths of the absorber consisting of porous material are in particular needed for absorbing low frequencies due to the long wavelengths, since the most considerable amount of energy can be converted if the absorption material can engage in the speed maximum of the sound wave at λ/4 according to FIG. 1. As regards the technical interior construction it is therefore necessary to already consider a significantly larger volume when planning the shell of a building, since in the worst case only half of the useable volume might be available due to the use of porous materials.

The optimization of costs has priority in the interior construction business. In order to reduce costs, shell heights of stories of a building are already reduced nowadays, so that acoustic ceilings with insufficient suspension heights have to be mounted in many cases.

This inevitably leads to development approaches of sound absorbers having a high absorption coefficient up to low frequencies even in case of a clearly reduced construction depth.

A sound absorber is known from the reference DE 295 02 964 U1, consisting of porous and fibrous material. The fibers can consist of plastic or metal. Porous materials which are intended to absorb sound can, however, also consist of other materials such as foam—as can be found in reference DE 4027511 C1. It is important that the system is open porous. The sound is supposed to be capable of penetrating the porous material and is to be converted into heat in there.

The longer the wavelength of sound, the larger the depth of such an absorber needs to be in order to be capable of successfully absorbing low frequencies as well. In order to be capable of also absorbing low frequencies a large construction volume of such a sound absorber is required, as can be found in the reference DE 4027511 C1. Absorbers having a relatively large thickness need to be employed then. On the one hand, the available space is thus reduced. On the other hand, such absorbers are comparatively expensive, since a relatively high amount of material has to be used.

In order to ensure that in case of small construction depths broadband frequencies and in particular low frequencies can be absorbed, it is suggested according to DE 4027511 C1 to provide a hybrid sound absorber which comprises an electronic system in addition to a conventional, passive absorber used to muffle sound. In other words, much technical effort is being made which furthermore calls for a power supply as well.

From the references DE 4113628 C2 as well as DE 2408028 A1 sound absorbers emerge which comprise porous material with closed pores.

In order to avoid a large construction volume, so-called plate resonators are alternatively employed. Such a plate resonator is described in the reference DE 10213107 A1. The plate resonator known from said reference comprises a rotatably mounted metal plate. This principle bases on the plate being set in motion, i.e. sound is converted into kinetic energy of the plate. A muffling medium is disposed behind such a plate, such as air or any other muffling material. Here, the kinetic energy of the plate is converted into heat. Corresponding to the predetermined resonance frequency of such a plate resonator respective frequencies will be absorbed. Despite low construction depth low frequencies can thus be absorbed. However, such a plate resonator absorbs only certain frequencies corresponding to the predetermined resonance frequency. In addition, the plate resonator is relatively expensive due to the metal plate.

In order to absorb high frequencies along with low frequencies in a plate resonator plate resonators are combined with foam materials, for example, as can be seen in the reference WO 96/26331 A1. The plate resonator is then adjusted, so that low frequencies are filtered. The high frequencies are filtered by the porous material. Although a relatively large spectrum of frequencies is absorbed in such a solution, additional materials are required which cause higher costs and increase the demand for space.

So-called Helmholtz resonators are used as an alternative. These resonators comprise a perforated plate with a volume located behind. A relatively large air volume is necessary behind a perforated plate to be able to absorb low frequencies. A Helmholtz resonator thus consumes a relatively large amount of space in turn. An individual Helmholtz resonator can absorb only a predetermined relatively small range of frequencies. A Helmholtz resonator emerges from the reference DE 8916179 U1 or else from the reference EP 1570138 A1.

Plates or foils having micropores are employed in a Helmholtz resonator instead of perforated plates, as known from reference DE 10151474 A1. Additional absorption occurs at the edges of the micropores. As a result, the effect of a Helmholtz resonator is improved.

A sound absorber is known from the reference DE 7427551 U which comprises two different porous materials. One of the two porous materials is chosen, so that the sound absorber is mechanically stable. The second porous material is chosen, so that it is especially inexpensive. In this way, the production costs are supposed to be reduced. The problem of providing a high construction depth capable of also absorbing low frequencies does still exist in this solution.

Object of the invention is to provide an inexpensive sound absorber which has the ability to absorb sound in a wide bandwidth despite low construction depth, and in particular low frequencies.

The object of the invention is solved by a sound absorber having the characteristics of claim 1. Advantageous embodiments will become apparent in the subclaims.

In order to solve this objective, a sound absorber is provided having a plurality of porous layers or regions. No air gap remains between the porous layers or regions. The transition from one porous layer to an adjacent porous layer is accompanied by an impedance shift. This means that the input impedance and the input resistance respectively of a porous region differs from the input impedance of an adjacent porous region so significantly that hereby low frequencies below 600 Hz, preferably below 500 Hz, are absorbed.

In particular, at least 50% of sound having a frequency below 600 Hz is absorbed, preferably at least 80%.

In one embodiment of the invention it is thus achieved that at least 50% of the sound having frequencies in ranges of special interest between approx. 200 and approx. 700 Hz is absorbed, preferably at least 80%. This specification consistently relates to the entire specified frequency range. Preferably, at least 80% of sound having all audible frequencies from 250 Hz onwards is absorbed. This is accomplished in particular by means of an absorber according to the claims with a maximum thickness of 10 cm and which lies flat against a wall or ceiling.

Apart from a housing for the porous layers and regions respectively the absorber according to the claims comprises in one embodiment no further components, such as plates or the like.

An impedance shift occurs when the sound propagation rate in a porous layer is different compared to the adjacent porous layer.

A different sound propagation rate in different porous layers and a different input resistance respectively is present on a regular basis, when the densities, the flow resistances or the porosities of two porous layers or regions are different. If a porous layer differs from another porous layer only by density, porosity or flow resistance, it is obligatory for both porous layers to have a different input resistance. Further parameters, such as compression hardness and tensile strength of a porous layer affect the input impedance as well.

The larger an impedance shift, the lower the frequencies are which are absorbed as a result of said impedance shift. The boundary surfaces between the different, porous layers which come along with rapid changes of the input resistances are therefore of importance.

A thermal frictional effect is desired in the porous material in particular to absorb higher frequencies as well. The thermal frictional effect which forms the basis of conventional porous sound absorbers is according to the invention only one element of the absorptive working mechanism. The effect known in physics as refraction is also used in particular. There is an impedance shift at the boundary layer between two materials having different input resistances, e.g. due to a different density or different flow resistances. This causes a phase shift of the sound wave, so that a sound absorption effect becomes possible. In case of frequently changing transitions and porous materials having suitably different input resistances each significantly higher sound absorption levels in the range of low frequencies—in particular between 200 Hz and 700 Hz as well—can be achieved in contrast to exclusively porous layers with homogenous or steadily increasing input resistances.

An absorber according to the present invention thus consists of at least two, preferably of at least three porous layers or regions which are different. It is essential that the boundary layer between the layers or regions is designed, so that they are connected by an impedance shift. The impedance shifts are to be chosen with a suitable value in order to be capable of absorbing low frequencies well.

However, an impedance shift must not be so large that sound does no longer get from the one material to another. A large impedance shift is achieved on a regular basis, when the densities of two bordering porous layers or regions differ greatly and in particular preferably by at least 20 $kg/m^3$ or when the flow resistances differ greatly and in particular preferably by at least 5 $kPa \cdot s/m^2$.

With the present invention, the idea of an even absorption of a frequency spectrum is abandoned. The lower frequencies are problematic. It is relatively easy and inexpensive to absorb high frequencies. By means of the impedance shift(s) it can be achieved that low frequencies are able to be absorbed particularly well. The larger an impedance shift, the lower frequencies can be absorbed.

Providing an impedance shift is in conflict with the prevailing opinions known from prior art: according to that, in case of different, porous materials, it is necessary to pay attention to differences of input impedances that are as small as possible in order to minimize reflections at boundary layers in order to achieve good absorption results.

Preferably, a sound absorber according to the present invention consists of several different porous layers or regions, so that impedance shifts of different value occur. In this way it is achieved that low frequencies are absorbed in a broadband range. If there are several different layers with boundary layers which always show the same impedance shift, the absorption effect is intensified relative to a frequency and a narrow frequency band respectively. If there are different impedance shifts, i.e. impedance shifts of different value, the spectrum which is absorbed due to the impedance shifts is extended.

Thus, it is possible to easily absorb low frequencies and in particular also those frequencies of special interest ranging from approx. 200 to approx. 700 Hz using a system only 10 cm in thickness. Since otherwise usual porous material is provided, higher frequencies are easily absorbed as well by a sound absorber according to the claims. All in all a broadband sound absorption can thus be accomplished which is particularly also able to absorb the low frequencies even in case of construction depths of merely 10 cm.

PU foams have proven to be an especially suitable porous material having different porosity and different density. Semi-closed PU foams can be employed as well. A semi-closed porous material has open as well as closed pores. PU foams include PU foams on the basis of polyester or polyether with a variable cell structure, compression hardness, density, air permeability and tensile strength.

For the provision of porous material it is only foams that are especially preferred in contrast to fibrous materials. One advantage of foams is that they have a rigid skeleton structure. If in total such a rigid skeleton structure is present it is additionally stimulated to vibrate. This causes additional absorption.

It is advantageous to first provide porous material having a relatively high input resistance at the site where the sound enters the absorber. Such an entry region comprises in general openings through which the sound can enter the porous material. The entry region can be formed by a plate or foil with holes or by a perforation. Here, the material with the relatively high input resistance boarders. One or several porous regions having a lower input resistance are disposed behind.

For example, a sound absorber has a semi-closed porous material at the entry of the absorber due to this reason. Materials which are completely open porous are then disposed spatially behind the semi-closed porous material. The target absorption of low frequencies can be achieved especially well in this way.

The different porous layers or regions are preferably pressed together in case of the sound absorber according to the claims. In order to press the porous layers or regions together they are accommodated, for example, in a suitably dimensioned case or housing. The case or housing respectively is closed by a porous or perforated surface at an entry side for sound. The porous layers are then pressured and thus compressed in the case.

The pressing power causes the skeleton structures of the individual porous layers to oscillate against each other. This results in an additional sound absorption effect.

In order to further optimize the sound absorption, a case or housing is provided which is not only acoustically permeable from a front side, but also from a lateral side, so that sound can also laterally enter the porous material easily. In this way, effects of the diffraction at the edge are utilized causing an additional absorption. Sound absorption can thus be further optimized.

One embodiment of the invention is especially preferred, wherein holes are provided in a case or housing on the front and on the side for the entry of sound waves. In particular, porous layers are preferably not only stacked on top of each other in such a case, but also laterally against an already present layer system. Here, in turn, much attention is paid to large impedance shifts. Thus, it is achieved that sound which laterally enters a case does not only get absorbed due to absorption at the edge, but also due to phase shifts at boundary layers.

In one embodiment of the invention the porous system consists of a plurality of cubes, cuboids or the like, which are disposed next to each other and above each other. The materials of the cubes, etc. are chosen, so that large impedance shifts between the boundary layers are present at least on a regular basis in the sense of the present invention. Thus, it can be achieved that sound propagating in the porous material is constantly confronted with large impedance shifts. Regardless at which angle or from which side sound penetrates the absorber, it passes through boundary layers with large impedance shifts at any case. This allows for variable geometries of the absorber. Its shape can then be adapted to fit into recesses or the like as well.

DETAILED DESCRIPTION OF THE INVENTION

In the following, the invention will be further discussed by means of the Figures.

Figure 1:
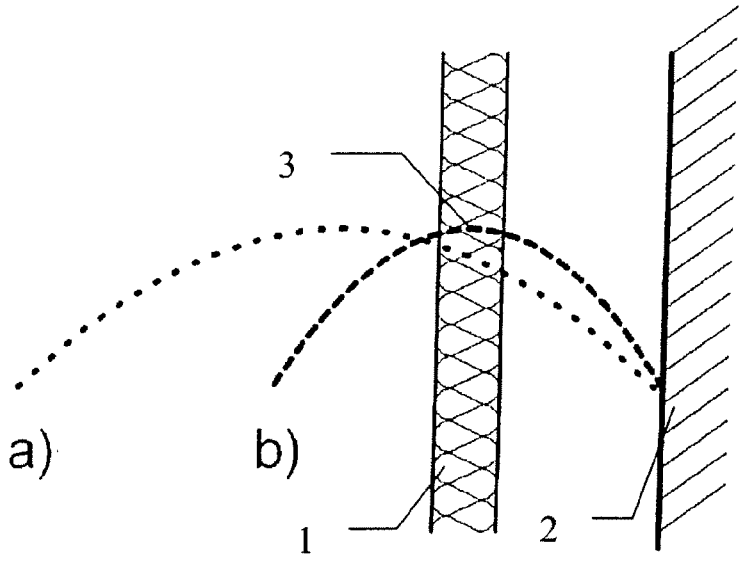
FIG. 1 illustrate porous absorbers according to prior art.

FIG. 1 is to illustrate why porous absorbers according to prior art must have a high construction depth in order to be able to ensure a satisfying absorption of low frequencies as well. The dotted line a) shows the wavelength of a low frequency sound wave which encounters a space limitation surface 2 after having passed through a porous layer 1. The sound speed maximum is external to the porous layer 1 serving as sound absorber. The low frequency is hardly absorbed. In case of higher frequencies and shorter wavelengths respectively, the speed maximum 3 is finally inside the porous layer 1, as illustrated by dashed line b). Sound having wavelength b) is thus optimally absorbed. This makes clear that a porous absorber has to be very thick and must have a large construction depth respectively if the absorption only bases on the porosity of the material 1 and if low frequencies are supposed to be absorbed as well.

Figure 2:
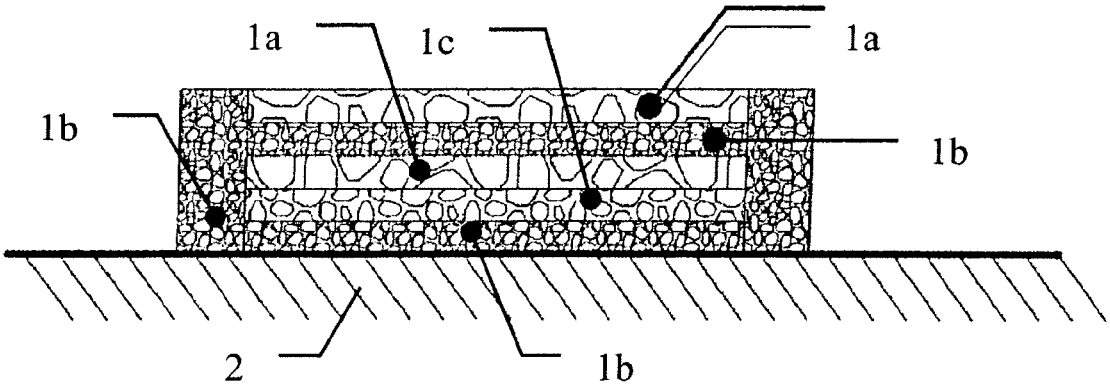
FIG. 2 shows a first embodiment of the present invention which several regions.

FIG. 2 shows a first embodiment. A porous absorber layer 1*a* (i.e. a region consisting of porous material) with large open pores is present in the front entry region for sound. The input resistance is thus small. A porous absorber layer 1*b* is located behind and on the side having small pores. The input resistance of this absorber layer is large. Between the front layer 1*a* and the layer 1*b* behind occurs thus an impedance shift which achieves an absorption of low frequencies ranging below 500 Hz. A layer 1*a* having large pores is present behind the layer 1*b* with the small pores towards the wall. A layer 1*c* with medium-sized pores and a medium-sized input resistance borders said layer. Behind that layer is, in turn, a layer 1*b* having small pores which borders a wall 2. This results in four horizontal impedance shifts and two vertical impedance shifts. All impedance shifts cause an absorption of low frequencies ranging between 100 and 500 Hz. It is thus possible with such a design to achieve a good absorption of even low frequencies ranging from 100 Hz to 500 Hz.

Figure 3:
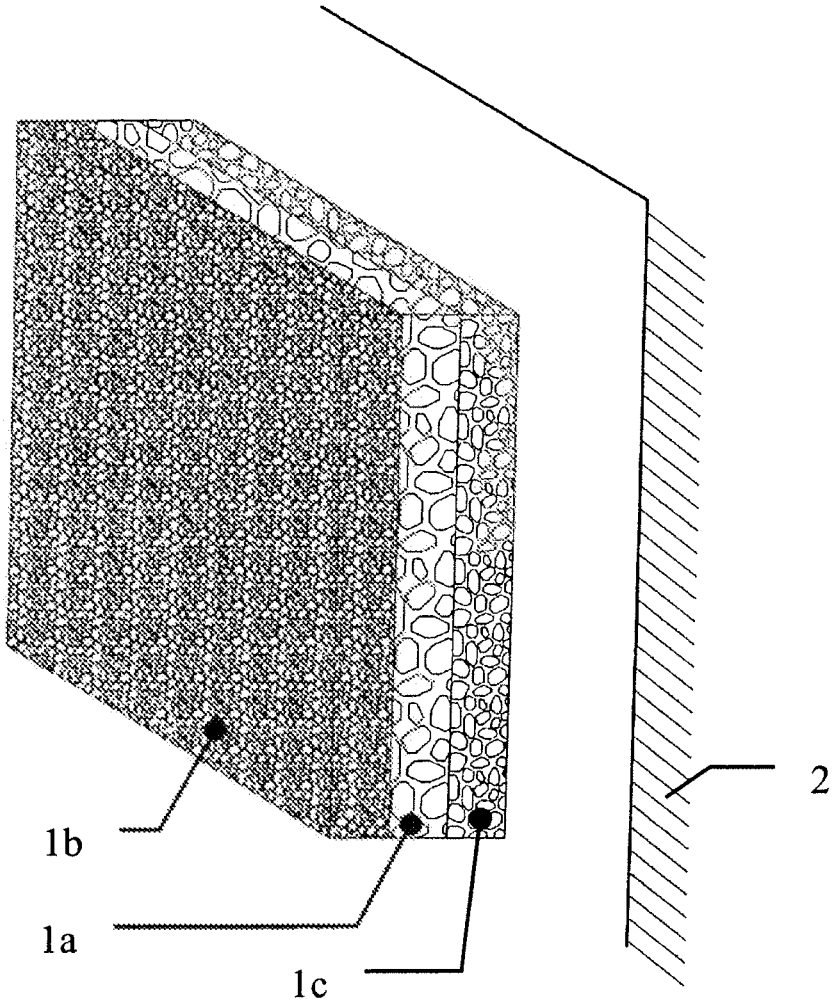
FIG. 3 shows a different design of the various porous layers.

FIG. 3 shows a different design of the various porous layers 1*a*, 1*b* and 1*c* mentioned above which are pressed against a wall 2 by a housing that is not shown. In such cases, however, a plate is sufficient for mounting purposes which is, for example, anchored in the wall by means of bars. If sound is supposed to be capable of penetrating the plate, as it is the case in FIG. 3, the plate is provided with holes. The porous layers are disposed exclusively parallel to the wall 2. The entry region begins with a layer 1*b* provided with small pores and a larger input resistance and input impedance respectively compared to the layers 1*a* and 1*c* disposed behind towards the wall.

Figure 4:
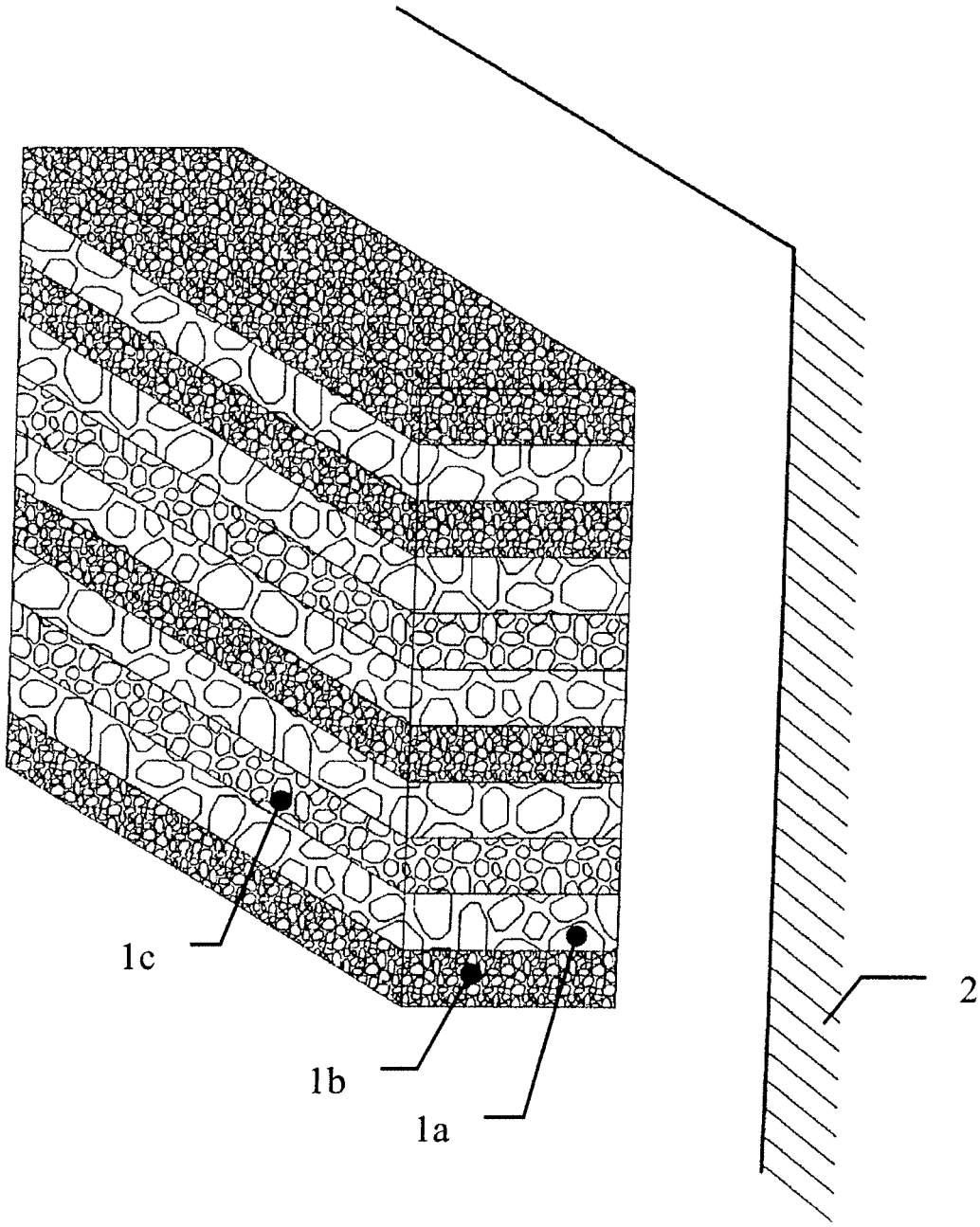
FIG. 4 shows another possible embodiment with different porous layers.

FIG. 4 shows another possible embodiment. The different porous layers 1*a*, 1*b* and 1*c* are horizontally stacked upon each other and are pressed against a wall 2. In this case it is favorable, when the sound can (also) enter the porous layers from the top and/or from the bottom, since then the sound is guided through many different boundary layers with impedance shifts especially reliably. Such an embodiment is to be preferred if a sound absorber is to be placed behind an object for example, such as a closet, since in such an arrangement the object hinders the sound from entering at the front side.

Figure 5:
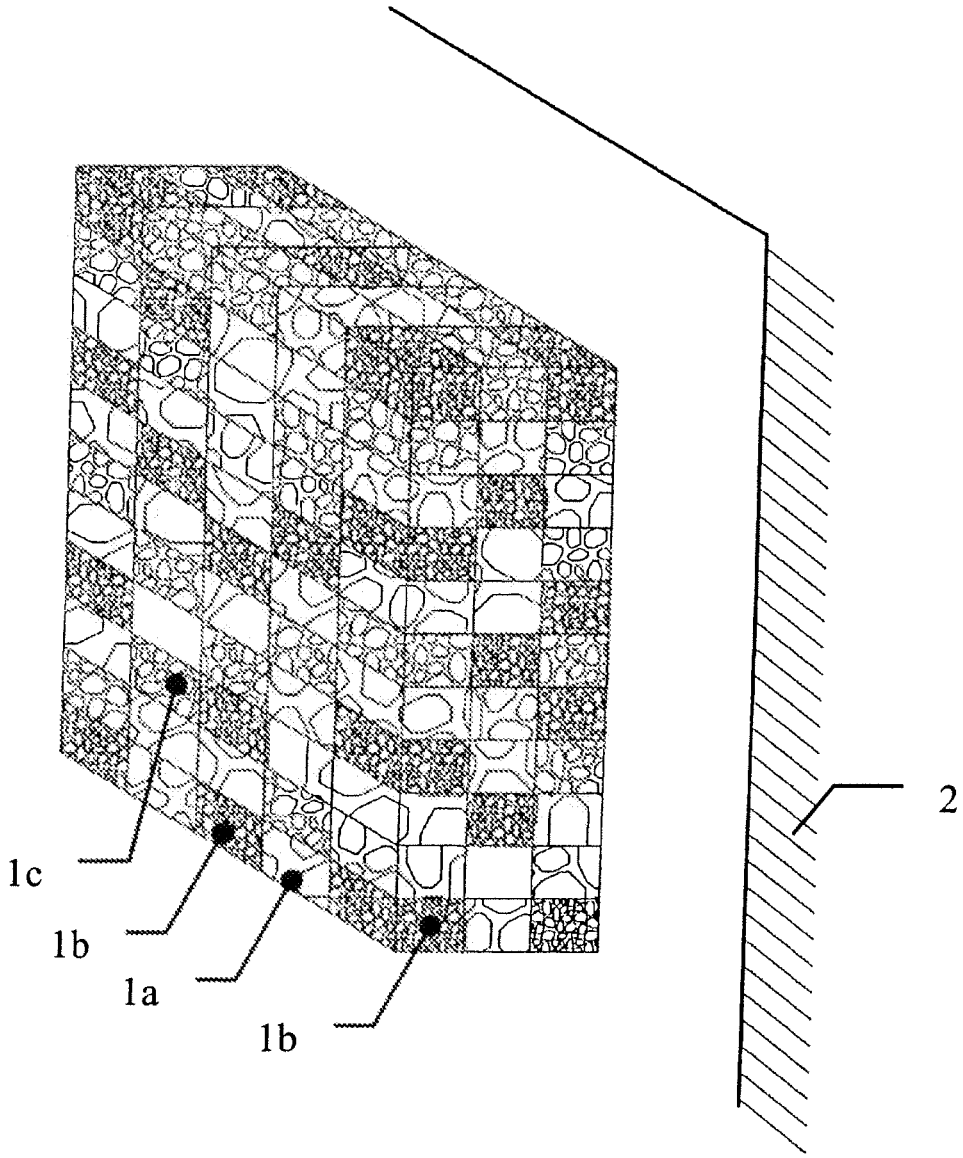
FIG. 5 shows an embodiment, wherein the absorbing region consists of a plurality of porous rectangles which are disposed on top of each other and next to each other, so that a plurality of impedance shifts occurs in each direction.

FIG. 5 shows an embodiment, wherein the absorbing region consists of a plurality of porous rectangles 1*a*, 1*b* and 1*c* which are disposed on top of each other and next to each other, so that a plurality of impedance shifts occurs in each direction. It does not matter at which side sound enters, as it will in any case penetrate a plurality of boundary layers, at which impedance shifts occur, which lead to the absorption of low frequencies. Such a design can also be suitably housed in a recess. A respective housing in which the porous rectangles are located is then preferably designed, so that sound can enter the housing from the front side, from both sides, from the top and from the bottom. But again an anchored plate may also be sufficient to fix the porous regions and to shield them optically.

Figure 6:
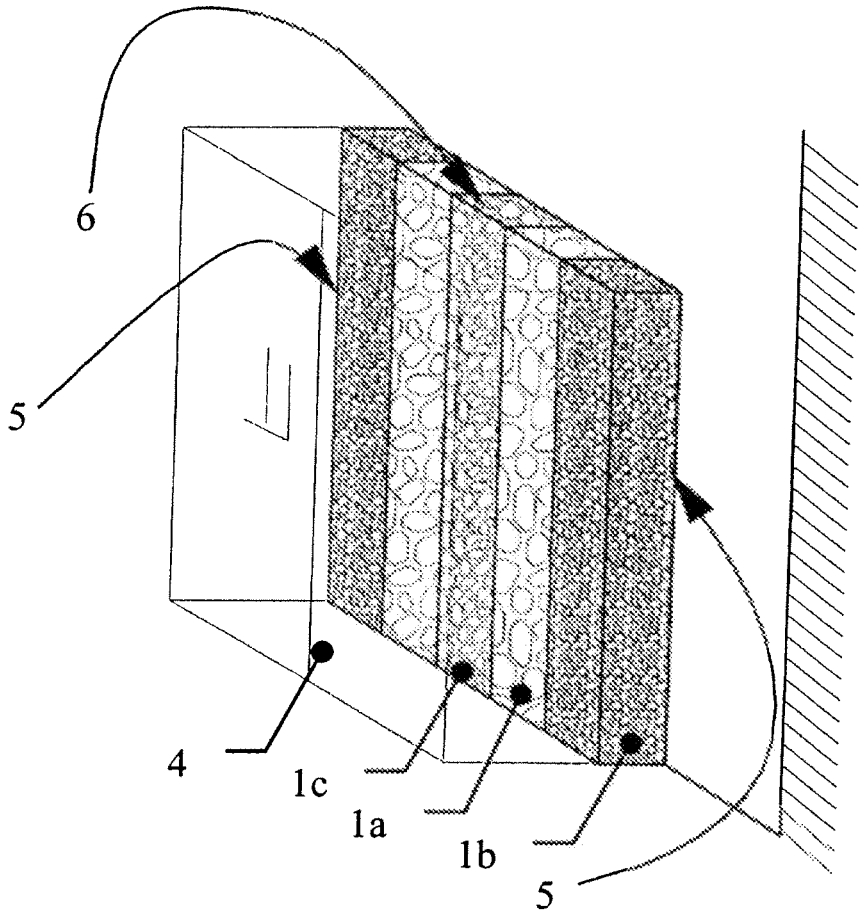
FIG. 6 illustrates a preferred embodiment which is located behind a closet.

FIG. 6 illustrates an especially preferred embodiment which is located behind a closet 4. The different porous regions 1*a*, 1*b* and 1*c* are vertically oriented, border a wall 2 and reach down to the floor, on which closet 4 is standing. If sound enters the porous regions 1*a*, 1*b* or 1*c* on the side, as indicated by arrows 5, the sound penetrates boundary layers with impedance shifts, causing the absorption of low frequencies. If the sound enters from the top along the arrow 6, sound does not necessarily penetrate boundary layers with impedance shifts. Therefore, the way to the floor is very long, which results in low frequencies being absorbed due to that reason. In such a design a special housing can be omitted, since the porous regions can be fixed on the backside of the closet.

The sound absorber according to the claims is, for example, used in modern interior construction. Especially, in the age of increased communication demands and high telecommunication human speech is the main source of irritation as regards reduced performance at work. Optimizing the room acoustics of offices, administration offices or open-plan offices has thus to be conducted according to the human speech spectrum.

Figure 7A:
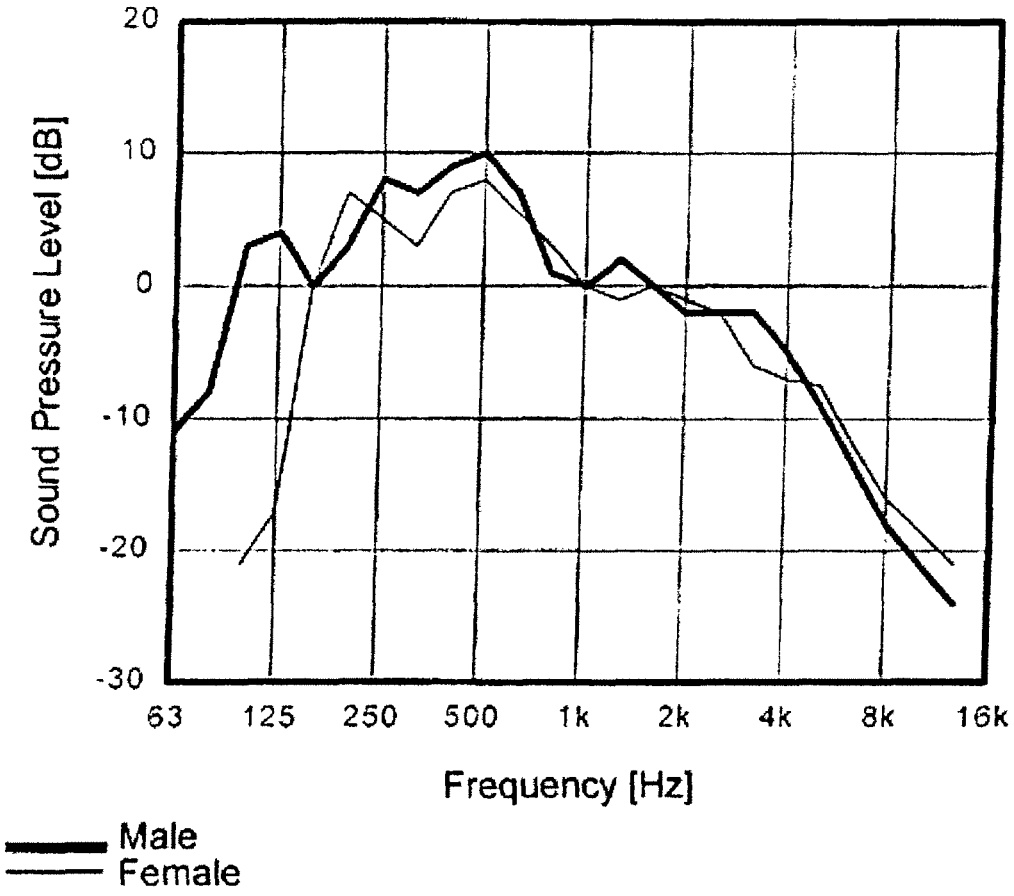
FIG. 7*a* shows the typical male and female speech spectrum of humans.

FIG. 7*a* hereby shows the typical male and female speech spectrum of humans. It becomes apparent that high sound pressure levels occur within a frequency range of approx. 100 and approx. 700 Hz which can be fully muffled using the absorber according to the invention even at construction depths of 20 cm or even at 10 cm.

Figure 7B:
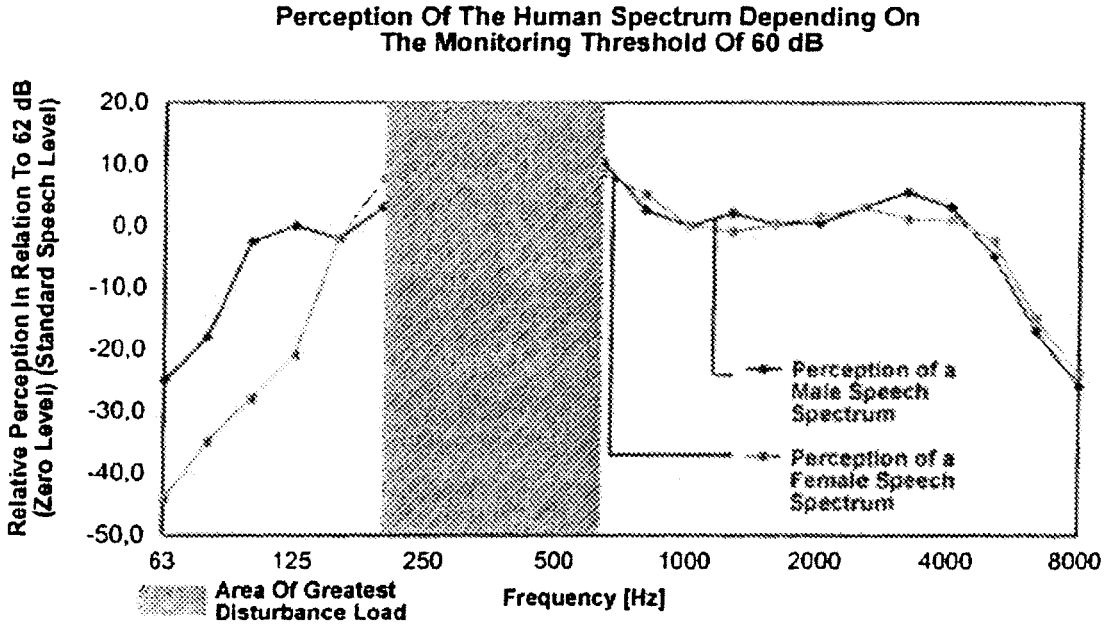
FIG. 7*b* illustrates the perception of the human spectrum depending on the monitoring threshold of 60 dB.

FIG. 7*b* illustrates the perception of the human spectrum depending on the monitoring threshold of 60 dB. It is thus important that sound with frequencies ranging from approx. 200 Hz to at least approx. 700 Hz can be fully absorbed in particular in rooms where sound is generated by human voices, such as in open-plan offices or in banks. This is provided by the absorber according to the claims and it is even superior to a plate resonator as regards said frequency range of special interest.

Figure 8:
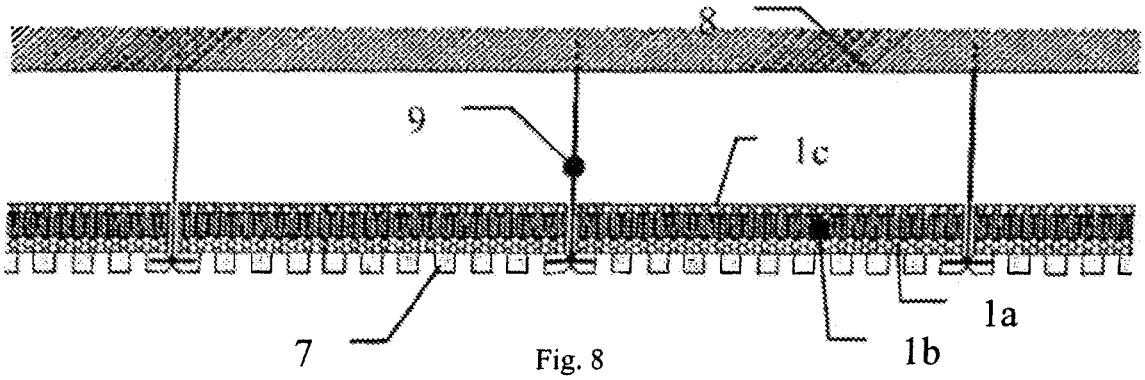
FIG. 8 shows an embodiment, wherein different porous layers are supported by a perforated, suspended subceiling which is mounted underneath a ceiling by means of suspension mount.

FIG. 8 shows an embodiment, wherein different porous layers 1*a*, 1*b*, 1*c* are supported by a perforated, suspended subceiling 7 which is mounted underneath a ceiling 8 by means of suspension mounts 9.

Due to the slender construction depth the sound absorber can be installed in partition walls, but also on front sides of furniture without attracting any attention. It can also be fixed to walls or ceilings, such as behind perforated plates which are attached to the wall or the ceiling and which press the different porous regions against a wall or a ceiling. It can be installed in lintel areas or in recesses of buildings, since its shape can be very variably adjusted to the space available. It can be accommodated very inconspicuously behind thermally functional wall or ceiling elements.

Figure 9:
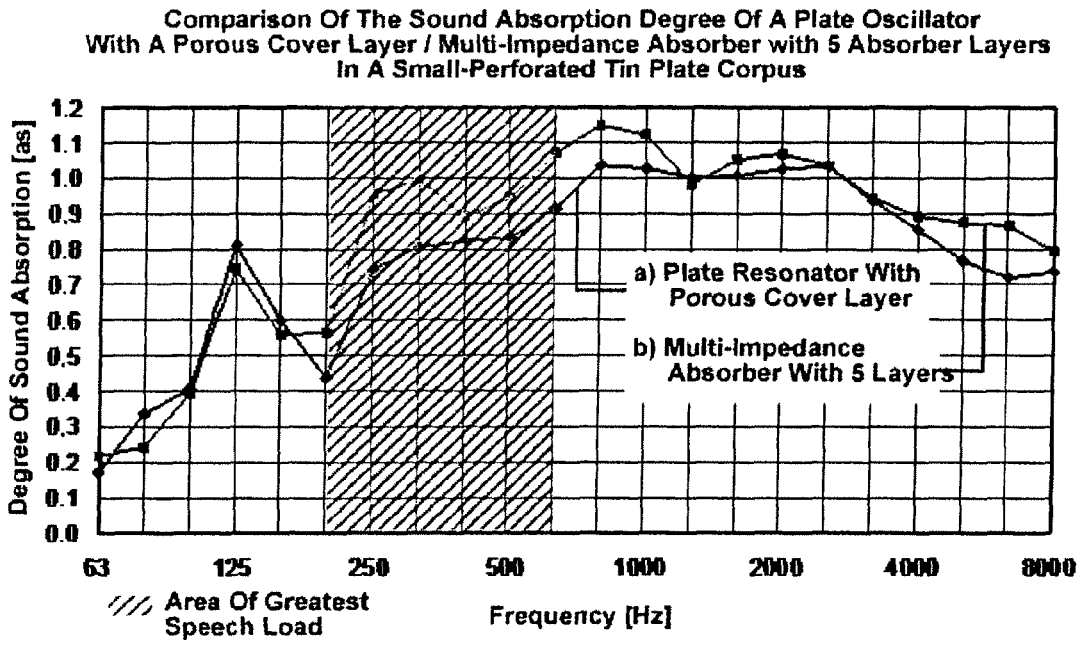
FIG. 9 shows results which have been achieved by a sound absorber according to the invention in comparison with a plate resonator.

FIG. 9 shows results which have been achieved by a sound absorber according to the invention in comparison with a plate resonator. The measurements were carried out in an echo chamber with statistic incident sound as to DIN EN ISO 354. As regards statistic sound incidence it is assumed that the sound pressure hitting a measurement microphone or a boundary surface has the same value regardless the incident angles and is location-independent as well.

Both sound absorbers were examined having the same dimensions and the same position in the room. The number and positions of the microphones for detecting the average reverberation time remained the same as well. Relative measurement errors, e.g. due to harmonics of the room, are thus virtually excluded and a direct comparison of the sound absorbers is possible.

Figure 10:
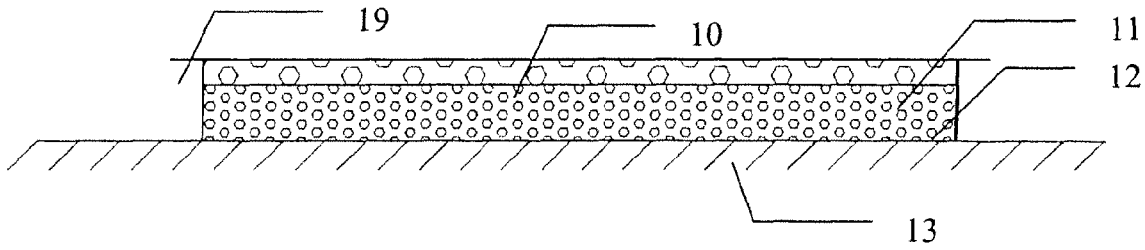

The graph a) shows the measured result for a plate resonator having a porous cover layer whose design is shown in FIG. 10. The plate resonator shown in FIG. 10 comprises a porous cover layer 10 having a thickness of 0.03 m, a length specific flow resistance of 4.7 kPas/m$^2$ and a density of 20 kg/m$^3$.

Below the cover layer 10 is a metal plate 11 having a thickness of 0.001 m and a density of 7800 kg/m$^3$. A porous layer 12 having a thickness of 0.07 m, a length specific flow resistance of 11.5 kPas/m$^2$ and a density of 40 kg/m$^3$ is disposed below the metal plate. The porous layer 12 boarders a sound-reflecting wall 13.

Figure 11:
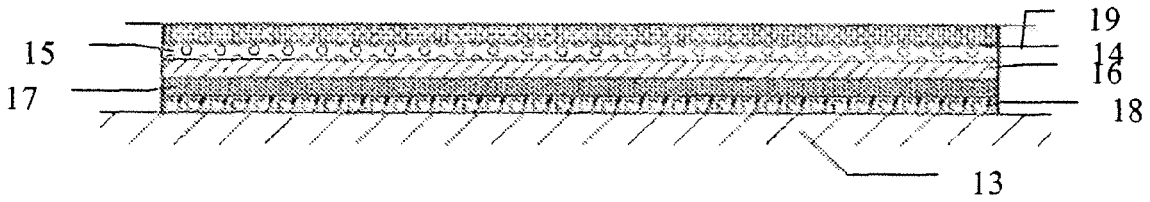

The other graph shown in FIG. 9 relates to a sound absorber according to the invention whose essential design is shown in FIG. 11. The sound absorber consists of five different porous foam layers 14, 15, 16, 17 and 18 which boarder a sound-reflecting wall 13.

Both absorber, i.e. both the plate resonator and the absorber according to the invention, were accommodated in the same housing 19 which was made of a sheet steel frame having a small-perforated front side.

The graph b) in FIG. 9 illustrates the absorption depending on the frequency for a sound absorber according to the claims with impedance shifts between the individual layers, the individual layers 14, 15, 16, 17 and 18 having the following characteristics:

14 porous layer with
- thickness=0.02 m
- air permeability>350 mmWS
- density=76 kg/m$^3$
- compression hardness=9.00 kPa
- tensile strength=194 kPa

15 porous layer with
- thickness=0.02 m
- air permeability>350 mmWS
- density=76 kg/m$^3$ compression hardness=4.77 kPa
tensile strength=47 kPa

16 porous layer with
thickness=0.02 m
air permeability=320 mmWS
density=75 kg/m$^3$
compression hardness=8.81 kPa
tensile strength=211 kPa

17 porous layer with
thickness=0.02 m
air permeability=230 mmWS
density=23 kg/m$^3$
compression hardness=4.36 kPa
tensile strength=131 kPa

18 porous layer with
thickness=0.02 m
air permeability 350 mmWS
density=75 kg/m$^3$
compression hardness=9.08 kPa
tensile strength=195 kPa The air permeability represents a measure for the flow resistance. In contrast to the other layers, layer 15 is not a foam with open pores but with semi-closed pores.

In case of very low frequencies below 140 Hz the plate resonator (graph a) is still slightly superior to the sound absorber according to the invention. This, however, changes from frequencies of approx. 150 Hz on. In the range of the highest speech load, however, the absorber according to the invention is superior to the plate resonator, and in most cases the superiority is extremely obvious. Hence, the absorber according to the invention can not only be manufactured more inexpensively compared to the plate resonator. Furthermore, it is much more suitable to absorb such kind of sound in rooms generated by human speech. By means of the sound absorber according to the invention, an absorption of the sound of more than 80% even at low frequencies having less than 500 Hz was achieved.

All in all, sound is best absorbed in the frequency range of interest with the sound absorber according to the invention as to graph b). The production costs of the sound absorber according to the invention corresponding to graphs b) are significantly lower compared to the plate resonator corresponding to graph a), as no relatively expensive metal plate is needed.

By comparison, porous, homogeneously designed sound absorbers with a thickness of 10 cm cannot achieve absorption values that are nearly as good as those of the examined plate resonator according to graph a) as well as those of the sound absorber of the invention according to Figure b).

The invention claimed is:

1. A sound absorber having porous material for muffling sound, comprising:

a first porous foamed layer comprising a first porosity;

a second porous foamed layer comprising a second porosity different than the first porosity of the first porous foamed layer, the second porous foamed layer being stacked on the first porous foamed layer and forming a first bordering region therebetween and having pores of a different size than the first porous foamed layer;

a third porous foamed layer comprising a third porosity different than the first porosity of the first porous foamed layer and the second porosity of the second foamed porous layer, the third porous foamed layer being stacked on the second porous foamed layer and forming a second bordering region therebetween, wherein:

the first and second bordering regions are different in that they have at least one of different input impedances, different sound propagation rates, different densities, different porosities, different flow resistances and at which there is an impedance shift between two bordering regions, wherein the first and second bordering regions are designed, so that there are at least two different boundary layers between the regions having impedance shifts of different value so that sound having frequencies below 600 Hz will be absorbed by at least 50%.

2. The sound absorber according to claim 1, wherein the densities of the first and second bordering regions differ by at least one of at least 20 kilogram/cubic meters and in that the flow resistances of two bordering regions of the porous material differ by at least 5 kilopascalsecond/square meter.

3. The sound absorber according claim 1, wherein the construction depth of the sound absorber is smaller than 20 cm, preferably smaller than 10 cm.

4. The sound absorber according to claim 1, wherein the porous foamed layers are formed by foams and preferably by PU foams.

5. The sound absorber according to claim 1, wherein one region adjacent to the entry region for sound has a higher flow resistance into the sound absorber compared to a bordering porous region positioned behind which is disposed more remotely from the entry region for sound.

6. The sound absorber according to claim 1, wherein the first, second and third porous foamed layers are pressed against each other.

7. The sound absorber according to claim 1, further comprising an entry region for sound through a front side as well as by further lateral entry regions for sound, the entry region through the front side being preferably formed by a perforated plate.

8. The sound absorber according to claim 1, wherein the different regions which comprise porous material are disposed on top of each other as well as next to each other.

9. The sound absorber according to claim 1, wherein the flow resistance does not steadily increase from an entry region for sound into the sound absorber up to the opposite border surface of the sound absorber.

10. The sound absorber according to claim 1, wherein no air gap remains between the first and second bordering regions of the porous foamed layers.

11. The sound absorber according to claim 1, wherein the first and second porous foamed layers comprises at least one of open pores and semi-closed pores.

12. The sound absorber according to claim 1, wherein it is disposed behind a closet.

13. The sound absorber according to claim 1, wherein the different porous regions run vertically behind a piece of furniture from the top side of said furniture to the floor and sound may enter these regions from the top and from the side.

14. The sound absorber according to claim 1, wherein it is supported by a suspended subceiling.

15. The sound absorber according to claim 1, wherein the present impedance shift(s) are that large, so that sound having frequencies below 500 Hz, will be absorbed by at least 80%.

16. A sound absorber having porous material for muffling sound, comprising:

a plurality of porous rectangles forming at least a first layer and a second layer provided within a housing, the plurality of porous rectangles of the first layer and the second layer are disposed on top of each other and next to each other, so that a plurality of impedance shifts occurs in each direction for the first layer and the second layer, the plurality of porous rectangles in the first layer comprising at least:

a first pourous material of rectangular shape;

a second porous material of rectangular shape, in contact with the first porous material forming a boundary layer with an impedance shift;

a third porous material forming another boundary layer with at least one of the first porous material and the second porous material, the another boundary layer having an impedance shift; and a fourth porous material of rectangular shape forming a boundary layer with at least one of the first porous material, the second porous material and the third porous material, the boundary layer formed with the fourth porous material having an impedance shift;

the plurality of porous rectangles in the second layer comprising at least:

the first pourous material of rectangular shape;

the second porous material of rectangular shape, in contact with the first porous material forming a boundary layer with an impedance shift;

a third porous material forming another boundary layer with at least one of the first porous material and the second porous material, the another boundary layer having an impedance shift; and a fourth porous material of rectangular shape forming a boundary layer with at least one of the first porous material, the second porous material and the third porous material, the boundary layer formed by the fourth porous material having an impedance shift, wherein the first porous material, the second porous material, the third porous material and the fourth porous material of both the first layer and the second layer have different properties resulting in different input resistances, and the first layer and the second layer abut one another and foam a plurality of boundary layers therebetween with different impedance shifts.

17. The sound absorber according to claim 16, wherein the different properties between the first porous material and the second porous material and the third porous material includes at least one of different input impedances, different sound propagation rates, different densities, different porosities and-different flow resistances.

18. The sound absorber according to claim 16, wherein the third layer of porous material borders at least one of the first porous material and the second porous material forming a second boundary layer.

19. The sound absorber according to claim 16, wherein the first porous material has a relatively high input resistance at a site where sound enters the sound absorber, which comprises a plate or foil with holes or perforation, and the second porous material is disposed behind the first porous material and has a lower input resistance than the first porous material.

20. A sound absorber having porous material for muffling sound, comprising:

a first porous layer comprising a first porosity;

a second porous layer comprising a second porosity different than the first porosity of the first porous layer, the second porous layer being stacked on the first porous layer and forming a first bordering region therebetween;

a third porous layer comprising a third porosity different than the first porosity of the first porous layer and the second porosity of the second porous layer, the third porous layer being stacked on the second porous layer and forming a second bordering region therebetween, wherein:

the first and second bordering regions are different in that they have at least one of different input impedances, different sound propagation rates, different densities, different porosities, different flow resistances and at which there is an impedance shift between two bordering regions, wherein the first and second bordering regions are designed, so that there are at least two different boundary layers between the regions having impedance shifts of different value, a fourth porous layer having the second porosity is stacked on a side of the first porous layer, opposing the second porous layer, and edges of the first porous layer, the second porous layer and the third porous layer.

21. A sound absorber having porous material for muffling sound, comprising:

a first porous layer comprising a first porosity;

a second porous layer comprising a second porosity different than the first porosity of the first porous layer, the second porous layer being stacked on the first porous layer and forming a first bordering region therebetween;

a third porous layer comprising a third porosity different than the first porosity of the first porous layer and the second porosity of the second porous layer, the third porous layer being stacked on the second porous layer and forning a second bordering region therebetween, wherein:

the first and second bordering regions are different in that they have at least one of different input impedances, different sound propagation rates, different densities, different porosities, different flow resistances and at which there is an impedance shift between two bordering regions, wherein the first and second bordering regions are designed, so that there are at least two different boundary layers between the regions having impedance shifts of different value; and further comprising stacking a fourth porous layer having the second porosity on a side of the first porous layer, opposing the second porous layer, wherein:

the first porous layer, the second porous layer, the third porous layer and the fourth porous layer comprise a single stack; and the single stack is stacked on another stack comprising a fifth porous layer, a sixth porous layer, a seventh porous layer and an eighth porous layer; and the fifth porous layer, the sixth porous layer, the seventh porous layer and the eighth porous layer having same porosities respectively of the first porous layer, the second porous layer, the third porous layer and the fourth porous layer.

22. The sound absorber according to claim 1, wherein the first porous layer, the second porous layer and the third porous layer are a plurality of porous rectangles provided within a housing and which are disposed on top of each other and next to each other, so that a plurality of impedance shifts occurs in each direction.

23. The sound absorber according to claim 1, wherein the first, second and third porous layers have a uniform thickness.

24. A sound absorber having porous material for muffling sound, comprising:

a first porous foam layer having a uniform thickness comprising a first porosity; and a second porous foam layer having a uniform thickness comprising a second porosity with smaller pore openings than the first porous foam layer, and being different than the first porosity of the first porous foam layer, the second porous foam layer being stacked on the first porous foam layer and forming a bordering region therebetween, wherein the bordering region of the porous material are different in that they have at least one of different input impedances, different sound propagation rates, different densities, different porosities, different flow resistances and at which there is an impedance shift between two bordering regions so that sound having frequencies below 600 Hz will be absorbed by at least 50%, the first and second porous foamed layers are pressed together in a housing having a perforated surface at an entry side for sound, and the first porous foamed layer is adjacent to the entry side and the perforated surface, and the first porous foamed layer has a higher flow resistance compared to the second porous foamed layer positioned behind the first porous foamed layer.

* * * * *